US006057949A

United States Patent [19]

Kinstler

[11] Patent Number: 6,057,949

[45] Date of Patent: May 2, 2000

[54] BI-DIRECTIONAL INFRARED COMMUNICATIONS SYSTEM

[75] Inventor: Gary A. Kinstler, Torrance, Calif.

[73] Assignee: The Boeing Company, Seal Beach, Calif.

[21] Appl. No.: 08/908,275

[22] Filed: Aug. 7, 1997

[51] Int. Cl.[7] ..... H04B 10/00

[52] U.S. Cl. ..... 359/164; 359/164; 359/158; 359/143; 359/154

[58] Field of Search ..... 359/158, 167, 359/164, 172, 165, 113, 143

[56] References Cited

U.S. PATENT DOCUMENTS

| | | | |
|---|---|---|---|
| 4,330,870 | 5/1982 | Arends | 455/870 |
| 4,882,770 | 11/1989 | Miyahira et al. | 455/603 |
| 4,916,689 | 4/1990 | Bielinski | 370/4 |
| 5,255,111 | 10/1993 | Kwa | 359/113 |
| 5,838,470 | 11/1998 | Radehaus | 359/124 |

*Primary Examiner*—Jason Chan
*Assistant Examiner*—Mohammad Sedighian
*Attorney, Agent, or Firm*—Lawrence N. Ginsberg

[57] ABSTRACT

An infrared (IR) transmitter modulator/receiver controller (TM/RC) encodes downlink serial digital data and precise time synchronization strobes from a host system to provide a downlink modulated serial digital electrical waveform. At least one IR host system transceiver (HST) converts the downlink modulated serial digital electrical waveform to a modulated downlink IR light waveform. At least one IR remote device transceiver (RDT) receives the modulated downlink IR light waveform from the HST. Each RDT is connected to a remote device. The modulated downlink IR light waveform is converted into a corresponding electrical waveform and further demultiplexed into its downlink serial digital data and precise time synchronization strobes. Each RDT provides an uplink electrical and IR modulated serial digital waveform to be received by the HST for conversion to an uplink demodulated serial digital electrical waveform. The HST transfers the uplink demodulated serial digital electrical waveforms to the TM/RC, thus providing a multiplexed combination of data and time information on the downlink and communication of uplink status information from the remote devices.

3 Claims, 3 Drawing Sheets

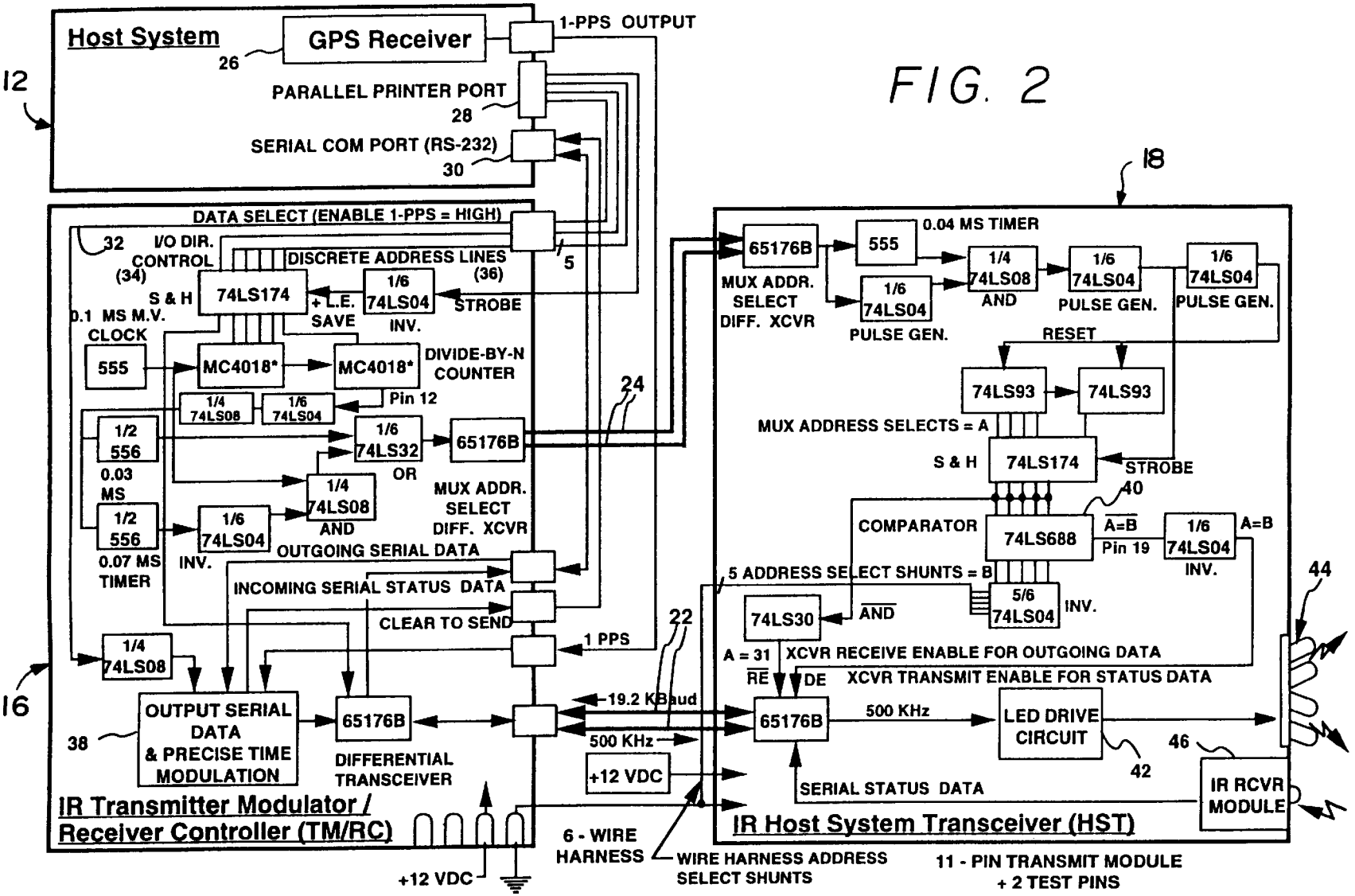
FIG. 2
Host System
12
GPS Receiver
26
1-PPS OUTPUT
PARALLEL PRINTER PORT
28
SERIAL COM PORT (RS-232)
30
IR Transmitter Modulator / Receiver Controller (TM/RC)
16
DATA SELECT (ENABLE 1-PPS = HIGH)
5
32
I/O DIR. CONTROL
(34)
DISCRETE ADDRESS LINES (36)
74LS174
S & H
STROBE
1/6 74LS04 INV.
+ L.E. SAVE
MC4018*
DIVIDE-BY-N COUNTER
Pin 12
1/4 74LS08
1/6 74LS04
555
0.1 MS M.V. CLOCK
1/2 556
0.03 MS
1/2 556
0.07 MS TIMER
65176B
1/6 74LS32 OR
1/4 74LS08 AND
1/6 74LS04 INV.
MUX ADDR. SELECT DIFF. XCVR
OUTGOING SERIAL DATA
INCOMING SERIAL STATUS DATA
CLEAR TO SEND
1 PPS
19.2 KBaud
500 KHz
+12 VDC
6 - WIRE HARNESS
WIRE HARNESS ADDRESS SELECT SHUNTS
22
24
OUTPUT SERIAL DATA & PRECISE TIME MODULATION
38
DIFFERENTIAL TRANSCEIVER
1/4 74LS08
IR Host System Transceiver (HST)
18
555
0.04 MS TIMER
1/4 74LS08 AND
1/6 74LS04 PULSE GEN.
MUX ADDR. SELECT DIFF. XCVR
MUX ADDRESS SELECTS = A
74LS93
RESET
74LS174
STROBE
S & H
40
74LS688
COMPARATOR
A=B
Pin 19
5/6 74LS04 INV.
5 ADDRESS SELECT SHUNTS = B
AND
74LS30
A = 31
RE
DE
XCVR RECEIVE ENABLE FOR OUTGOING DATA
XCVR TRANSMIT ENABLE FOR STATUS DATA
LED DRIVE CIRCUIT
42
500 KHz
SERIAL STATUS DATA
IR RCVR MODULE
46
44
11 - PIN TRANSMIT MODULE + 2 TEST PINS

BI-DIRECTIONAL INFRARED COMMUNICATIONS SYSTEM

BACKGROUND OF THE INVENTION

1. Field of the Invention

The present invention relates to a wireless communication system for accomplishing one-to-one and one-to-many bi-directional transfer of data and time synchronization information between a host system and a plurality of grouped or multiply-clustered remote devices. The invention is particularly directed to ground-, air-, or sea ship-based armament systems with Global Positioning System (GPS)-equipped munitions which require the downlink transfer of data and precise time to the munitions prior to their release to prepare guidance and targeting functions, enable rapid GPS receiver acquisition of the full military accuracy encrypted signal, and provide the uplink transfer of individual munition's launch preparation status information.

2. Description of the Related Art

Today's weapons systems increasingly rely on the use of precision guided munitions (PGM's) to improve the accuracy with which ordnance may be delivered to a target, thereby increasing the damage expectancy for each weapon, reducing collateral damage, and reducing the number of weapons and delivery platforms which must be utilized to achieve the desired level of damage. Reducing the number of weapons and sorties which must be committed to achieve a desired damage expectancy result minimizes crew exposure to enemy defenses and offers the potential for substantially reduced munitions and operations costs.

The transfer of target assignment, and other data initialization necessary to prepare a PGM's guidance system, and in many cases to a precision GPS navigational receiver as well, currently relies on a hardwire cable to each munition to transfer such information. The costs of installing and maintaining hardwire cable umbilicals to each weapon represent a significant fraction of the overall cost to field and operate a PGM munitions system.

Recent innovations to reduce the cost of upgrading host weapons systems to interface with PGM's have resulted in the elimination of the hardwire umbilical to PGM's, using instead a "virtual" hardwire connection consisting of some kind of wireless interface and self-contained munitions power. The Boeing Virtual Umbilical™ wireless weapon interface developed for a B-1B aircraft PGM, and now proposed for other aircraft and Naval gun systems, performs such an initialization function.

Present applicant, Gary A. Kinstler, is the inventor of U.S. Ser. No. 08/362,339, entitled "Virtual Umbilical Utilizing Infrared Serial Data Link", which teaches wireless downlink communications of data and time synchronization strobe for weapon guidance and GPS initialization utilizing a time division multiplex protocol over an infrared (IR) communication link. The '339 application provides no uplink communication channel for data such as status information. Present applicant, Gary A. Kinstler, is also the inventor of U.S. Ser. No. 08/721403 entitled "Remote Identification Location and Signaling Response System" which teaches uplink status information with a low-data-rate, spatially-discriminating communications sensor on the host side of the uplink. There may, however, be occasions where a higher uplink bandwidth is desired, and where uplink communications from individual remote devices can be alternatively managed with an individually-addressable command/response protocol, without the need for spatial discrimination.

As will be disclosed below, the present invention provides a high bandwidth data uplink which operates through, and is integrated with, the same network of distributed communications modules as used for the downlink, which is fully compatible with the time division multiplex protocol utilized for the downlink, and provides the capability for controlling the transfer of uplink data from individual munitions.

The method of this invention accomplishes bidirectional information transfer from the host system to each munition in a wireless fashion through a multiplexed network of distributed transceivers, as opposed to the use of hardwire umbilicals common in prior weapon system munitions launch preparation communications links.

The present invention provides a method and preferred embodiment for sharing the physical data transfer path to multiple distributed host transceivers for both downlink and uplink data and time transfer functions.

OBJECTS AND SUMMARY OF THE INVENTION

It is, therefore, a principal object of the present invention to provide a high bandwidth bi-directional wireless communication link between a host vehicle and a plurality of PGM's or any other local remote devices in a manner compatible with the existing downlink method for simultaneous transfer of data and precise time (e.g., GPS) information. This invention accomplishes this by expanding the existing downlink protocol to include uplink functions and by sharing the same physical electrical signal path for both uplink and downlink. This permits PGM weapons to be initialized and statused with out any hardwire connection to the host weapons system. This bi-directional capability provides the opportunity for substantial savings in interfacing precision guided munitions to host systems where it is required to both accomplish launch preparation and determine the status of launch preparation in precision guided munitions weapons systems.

These and other objects are achieved by the communications apparatus of the present invention, which is embodied in a host weapons system and associated PGM's. The apparatus is based on the known capabilities of current Virtual Umbilical™ wireless weapon interface implementations which provide a multiplexed protocol for downlink communications capability for transferring data and time information to a remote device, to wit a weapon. The apparatus of the invention is capable of providing a low cost and convenient means of preparation and statusing of a local remote device.

Other objects, advantages and novel features of the present invention will become apparent from the following detailed description of the invention when considered in conjunction with the accompanying drawings.

BRIEF DESCRIPTION OF THE DRAWINGS

FIG. 2 is a detailed block diagram illustrating functional blocks of the major components of the FIG. 1 implementation.

The same elements or parts throughout the figures are designated by the same reference characters.

DETAILED DESCRIPTION OF THE PREFERRED EMBODIMENT

Figure 1:
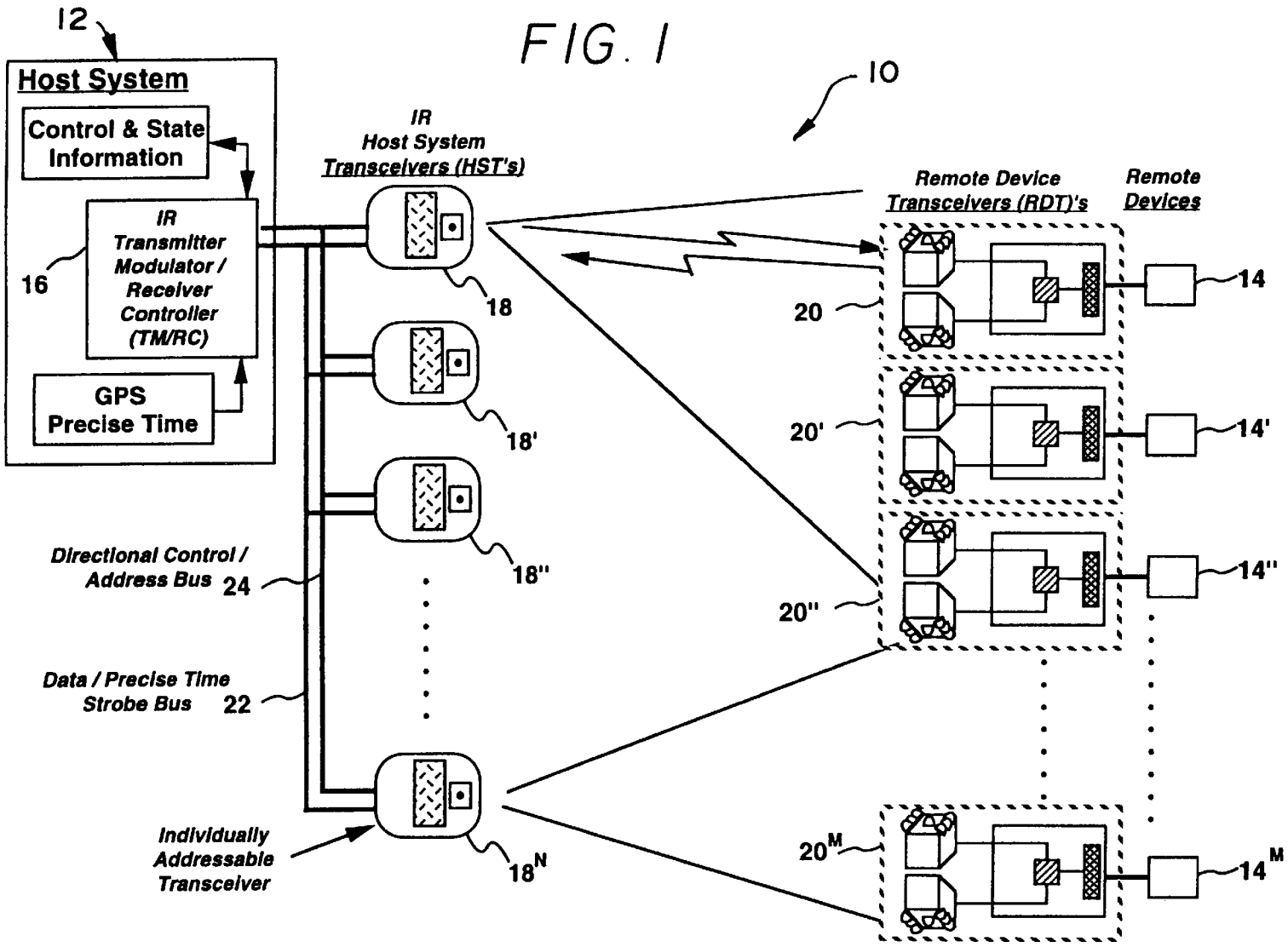
FIG. 1 is a block diagram of a preferred embodiment of the wireless bi-directional infrared communications system of the present invention, showing the major components thereof.

Referring now to the drawings and the characters of reference marked thereon, FIG. 1 shows a preferred embodiment of the wireless bi-directional infrared communications system of the present invention, designated generally as 10. The system 10 provides communication between a host system 12 and a plurality of remote devices 14, 14', . . . $14^M$. An infrared (IR) transmitter modulator/receiver controller (TM/RC) 16 encodes downlink serial digital data and precise time synchronization strobes from the host system 12 to provide a downlink modulated serial digital electrical waveform. A plurality of IR host system transceivers (HST's) 18, 18', . . . $18^N$ convert the downlink modulated serial digital electrical waveform to a modulated downlink IR light waveform. A plurality of IR remote device transceivers (RDT's) 20, 20', . . . $20^M$ receive the modulated downlink IR light waveform from the HST's 18. Each RDT 20 is connected to a remote device 14. The modulated downlink IR light waveform is converted into a corresponding electrical waveform and further demultiplexed into its downlink serial digital data and precise time synchronization strobe components. Each RDT 20 provides an uplink electrical and IR modulated serial digital waveform to be received by the HST's 18 for conversion to an uplink demodulated serial digital electrical waveform. The HST's 18 transfer the uplink demodulated serial digital electrical waveforms to the TM/RC 16, thus providing a multiplex combination of data and time information on the downlink and communication of uplink status information from the remote devices.

Although FIG. 1 illustrates use of a plurality of HST's 18 and RDT's 20, it is understood that the principles herein may be used to implement a system which may involve as few as only one HST 18 or one RDT 20.

A serial digital databus 22 is coupled between the TM/RC 16 and the plurality of HST's 18. The databus 22 is capable of carrying bi-directional serial data and precise time synchronization strobes in a time division multiplex protocol. A serial digital directional control/address bus 24 is coupled between the TM/RC 16 and the plurality of HST's 18. The control/address bus 24 is capable of specifying data direction and the enabling addresses for the HST's 18.

Referring now to FIG. 2, the host system 12 may include a hardware processor and software for controlling the initiation and conduct of the launch preparation cycle for remote devices. Such devices may include GPS aided precision guided munitions. The host system 12 typically also supplies some of the initialization data required by the precision guided munition, including a source of precise time strobe for GPS receiver initialization within the PGM. The source of such precise time strobe is generally available from a GPS receiver 26, providing such an output at a one-pulse-per-second (1-PPS) output. These data are provided at outputs from or within the host system 12 via, typically, a parallel printer port 28 for directional control/address specification and a RS-232 serial comport 30 for downlink and uplink of serial digital data.

The TM/RC 16 provides the functions of directional control, address encoding, selection of downlink data type, synchronization to the host system 12, transferring of bi-directional serial digital data between the host system 12 and the HST 18 and merging of the serial digital data and precise time strobes into the time division multiplex protocol. A total of nine discrete datalines connect the host system to the TM/RC 16. A first one specifies the nature of information to be encoded by the time division multiplex protocol, being either serial digital data or precise time strobes, as indicated by line 32. A second discrete control line defines the directional control of serial digital data. This line is indicated by numeral reference 34. Five discrete lines 36 control the encoded address specification.

The desired encoded address is captured by a sample-and-hold lock upon receipt of a discrete strobe from the host system 12. The desired encoded address is relayed to a divide-by-N counter. A square wave clock driver interfaces with the divide-by-N counter causing the counter to count down from its received address specification. A combination of two 556 one-shot timers create long and short pulses and, working together with the "AND" and "OR" gates therefollowing, construct the pulse count protocol. The resulting encoded address electrical signal from the OR gate is provided to a bus address differential transceiver driver.

The output serial digital data originating from the host system 12 is combined together with the precise time strobes from the host system 12 by the time division multiplex block 38, in accordance with the data select discrete 32. The output of the time division multiplexer 38 is provided to a differential transceiver driver for passing downlink information across the databus 22.

Uplink data received from the HST 18 across the serial databus 22 are received by the TM/RC 16 differential transceiver under direction of the I/O directional control 34 and relayed to the host system 12 through the host system serial port 30.

Typically the TM/RC 16 resides within host system 12 as do the interconnecting discrete and serial digital data lines between the TM/RC 16 and host system 12. Typically a wire harness, comprising the databus 22 and address bus 24, are used to connect the TM/RC 16 to remotely located HST's 18.

The functions of the HST's 18 are to decode the address information from the address bus 24, compare to its own assigned address for determining directional control and uplink enabling, and transmission and receipt of infrared modulated signals to the RDT's 20. A series of pulse generators, timers and "AND" gates are used to extract the address code from the pulse count address code signal on the control/address bus 24 for writing the result to a comparator 40. Discrete address select shunts (to signal ground) from the HST's 18 connector and harness define a unique address for each HST 18. The unique address of an HST 18 is compared to the bus decoded address in the comparator 40. The result of this comparison is used to control the direction of serial digital data through the HST 18 differential transceiver interfacing with the serial databus 22. Downlink serial digital data is converted to appropriate electrical drive waveform within the LED drive circuit 42. This causes IR modulated emission from the light emitting diode transmitter array 44 of the HST 18. Receipt of uplink modulated IR carrier signal is received by the IR receiver module 46 and relayed to the HST's differential transceiver.

Figure 3:
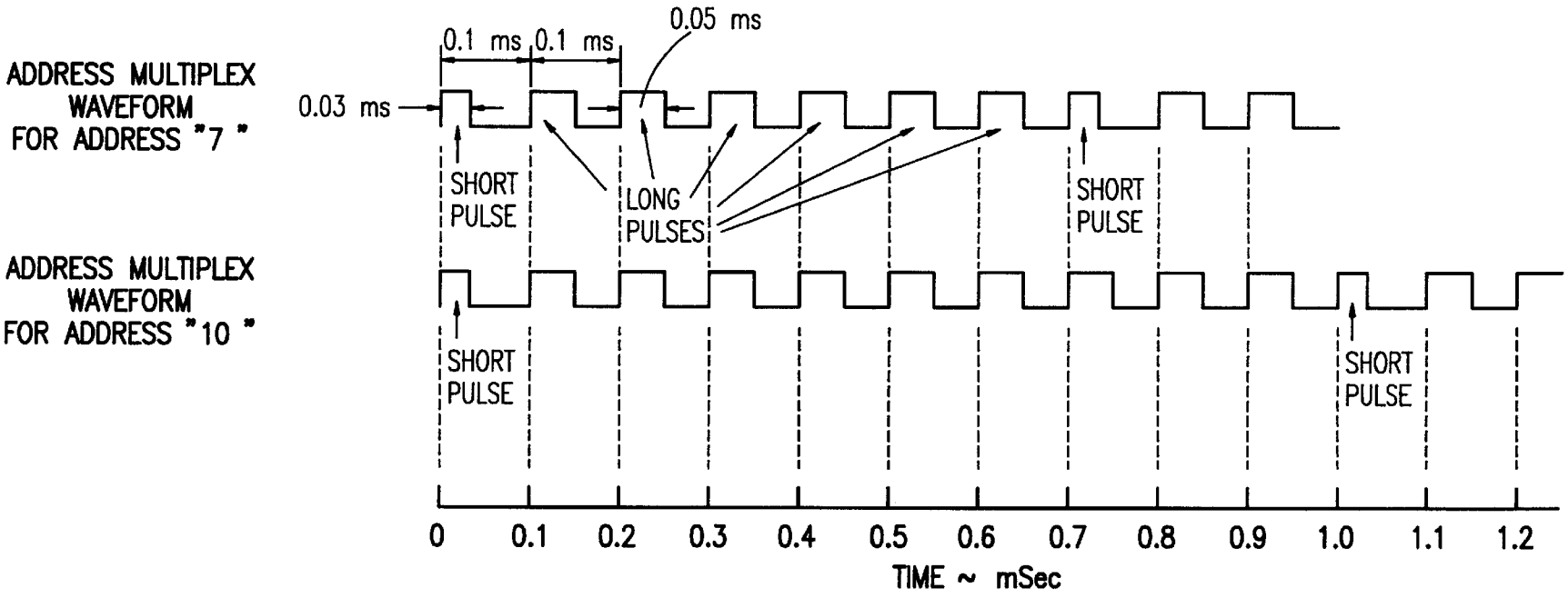
FIG. 3 is a diagram illustrating the timing relationships for the pulse count directional control/address encoding protocol of the FIG. 1 embodiment.

Referring now to FIG. 3, a timing diagram illustrating the timing relationships for the pulse count directional control/addressing coding protocol is illustrated. Address encoding is accomplished by means of a series of relatively long pulses separated by relatively short pulses. Nominally, short and long pulse durations may typically be on the order of 0.03 mS and 0.05 mS, the leading edges of which are equally spaced from one another at a constant interval of 0.1 mS. A specific address is denoted by the number of 0.1 mS interpulse intervals occurring between the leading edges of repeating short pulses. FIG. 3 shows an example of two specific waveforms, for addresses "7" and "10". For example, address "7" begins with the short pulse, with seven 0.1 mS interpulse periods before repeating the next short pulse.

The present invention provides an efficient means to provide downlink serial digital data and precise time, as well as uplink of serial digital status information to/from a plurality of remote devices (PGM's) over an efficient databus network.

Obviously, many modifications and variations of the present invention are possible in light of the above teachings. It is, therefore, to be understood that, within the scope of the appended claims, the invention may be practiced otherwise than as specifically described.

What is claimed and desired to be secured by Letters Patent of the United States is:

1. A bi-directional infrared communications system for providing communication between a host system and at least one remote device, comprising:

a) an infrared (IR) transmitter modulator/receiver controller (TM/RC) for encoding downlink serial digital data and precise time synchronization strobes from a host system to provide a downlink modulated serial digital electrical waveform;

b) at least one IR host system transceiver (HST) for converting said downlink modulated serial digital electrical waveform to a modulated downlink IR light waveform; and c) at least one IR remote device transceiver (RDT) for receiving said modulated downlink IR light waveform from said at least one HST, each said at least one RDT being connected to a remote device, said modulated downlink IR light waveform being converted into a corresponding electrical waveform and further demultiplexed into its downlink serial digital data and precise time synchronization strobes, wherein each said at least one RDT provides an uplink electrical and IR modulated serial digital waveform to be received by said at least one HST for conversion to an uplink demodulated serial digital electrical waveform, said at least one HST transferring said uplink demodulated serial digital electrical waveforms to said TM/RC, thus providing a multiplexed combination of data and time information on the downlink and communication of uplink status information from the at least one remote device.

2. The communications system of claim 1, wherein said at least one HST comprises a plurality of HST's.

3. The communications system of claim 1, wherein said at least one RDT comprises a plurality of RDT's.

* * * * *